US011631383B2

(12) United States Patent
Lin

(10) Patent No.: US 11,631,383 B2
(45) Date of Patent: Apr. 18, 2023

(54) RESOLUTION ADJUSTMENT METHOD AND DISPLAY DEVICE THEREOF

(71) Applicant: BENQ CORPORATION, Taipei (TW)

(72) Inventor: Hsin-Nan Lin, New Taipei (TW)

(73) Assignee: BenQ Corporation, Taipei (TW)

( * ) Notice: Subject to any disclaimer, the term of this patent is extended or adjusted under 35 U.S.C. 154(b) by 0 days.

(21) Appl. No.: 17/409,814

(22) Filed: Aug. 24, 2021

(65) Prior Publication Data

US 2022/0093065 A1 Mar. 24, 2022

(30) Foreign Application Priority Data

Sep. 18, 2020 (CN) ..... 202010985823.X

(51) Int. Cl.
*G09G 5/391* (2006.01)
*G09G 5/00* (2006.01)

(52) U.S. Cl.
CPC ..... *G09G 5/391* (2013.01); *G09G 5/005* (2013.01); *G09G 5/006* (2013.01); *G09G 2340/0407* (2013.01); *G09G 2354/00* (2013.01); *G09G 2370/047* (2013.01); *G09G 2370/22* (2013.01)

(58) Field of Classification Search
CPC ..... G09G 5/391; G09G 5/005; G09G 5/006; G09G 5/14; G09G 2340/0407; G09G 2354/00; G09G 2370/047; G09G 2370/22; G09G 2370/04; G09G 2370/08; G09G 2370/10; G09G 2370/20; G09G 2320/06; G09G 2352/00; H04N 21/4312; H04N 21/4858
See application file for complete search history.

(56) References Cited

U.S. PATENT DOCUMENTS

2013/0117499 A1* 5/2013 Shao ..... G06F 12/1425 711/E12.008
2018/0181362 A1* 6/2018 Kaneko ..... G09G 5/003

FOREIGN PATENT DOCUMENTS

CN 202930011 U * 5/2013
JP 2016-31468 A * 3/2016

* cited by examiner

*Primary Examiner* — Brent D Castiaux

(57) ABSTRACT

A resolution adjustment method applied to image display of a display device includes the display device providing a display menu to obtain a display layout composed of a plurality of display areas, the display device performing a resolution parameter setting on each display area according to the display layout and an original resolution parameter of the display device, the display device generating an updated product code and a plurality of updated resolution parameters according to an original product code and the original resolution parameter of the display device and each resolution parameter setting, and each image source reading the updated product code and the updated resolution parameter and outputting an image corresponding to the updated resolution parameter via a corresponding transmission port to the corresponding display area.

11 Claims, 4 Drawing Sheets

RESOLUTION ADJUSTMENT METHOD AND DISPLAY DEVICE THEREOF

BACKGROUND OF THE INVENTION

1. Field of the Invention

The present invention relates to a resolution adjustment method and a display device thereof, and more specifically, to a resolution adjustment method for modifying an original resolution parameter of a display device according to a display layout and a display device thereof.

2. Description of the Prior Art

In general, for helping a user multitask different activities (e.g. watching a video while performing word processing) conveniently, a display monitor usually has a multi-display function (e.g. a picture-in-picture (PIP) or picture-by-picture (PBP) function). The picture-in-picture function involves displaying images transmitted from an image source on a main display area with a current resolution of the display device (usually an optimal resolution of the display device) and displaying image transmitted from another image source on a secondary display area, which is overlapped on the main display area and has a resolution less than the resolution of the main display area. The picture-by-picture function involves dividing a main display area into a plurality of secondary display areas for displaying images transmitted from different image sources respectively. However, the image source usually outputs an image with the optimal resolution of the display monitor via a transmission port (e.g. a high definition multimedia interface (HDMI) port, a digital visual interface (DVI) port, etc.) of the display monitor according to an extended display identification data (EDID) of the display monitor. As such, no matter which type of display layout is displayed on the display monitor, the resolution of the secondary display area, which is less than the optimal resolution, cannot be matched with the resolution of the image transmitted from the image source, so as to cause the fuzzy image or ratio distortion problem.

SUMMARY OF THE INVENTION

The present invention provides a resolution adjustment method applied to image display of a display device. The display device has a plurality of transmission ports to be connected to a plurality of image sources respectively. The resolution adjustment method includes the display device providing a display menu to obtain a display layout. The display layout is composed of a plurality of display areas respectively corresponding to the plurality of transmission ports. The resolution adjustment method further includes the display device performing a resolution parameter setting on each display area according to the display layout and an original resolution parameter of the display device, the display device generating an updated product code and a plurality of updated resolution parameters corresponding to the plurality of display areas according to an original product code and the original resolution parameter of the display device and each resolution parameter setting, and each image source reading the updated product code and the corresponding updated resolution parameter and outputting an image with the corresponding updated resolution parameter via the corresponding transmission port to the corresponding display area.

The present invention further provides a display device having a resolution adjustment function applied to image display of a plurality of image sources. The display device includes a monitor, a storage unit, and a control unit. The monitor has a plurality of transmission ports to be connected to the plurality of image sources respectively. The monitor provides a display menu to obtain a display layout. The display layout is composed of a plurality of display areas corresponding to the plurality of transmission ports. The storage unit is disposed in the monitor. An original product code and an original resolution parameter of the monitor are stored in the storage unit. The control unit is electrically connected to the monitor and the storage unit. The control unit performs a resolution parameter setting on each display area according to the display layout and the original resolution parameter. The control unit generates an updated product code and a plurality of updated resolution parameters corresponding to the plurality of display areas according to the original product code, the original resolution parameter and each resolution parameter setting. Each image source reads the updated product code and the corresponding updated resolution parameter stored in the storage unit and outputs an image with the corresponding updated resolution parameter via the corresponding transmission port to the corresponding display area.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
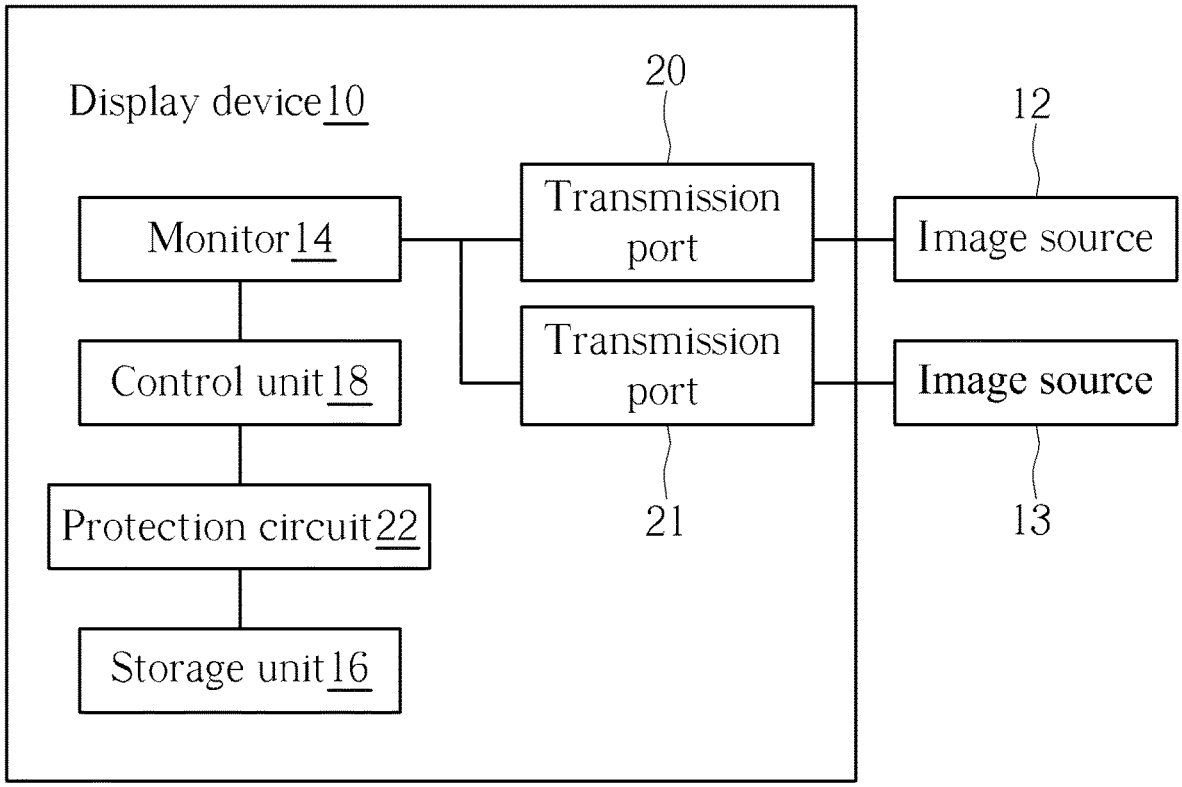
FIG. 1 is a functional block diagram of a display device according to an embodiment of the present invention.

Please refer to FIG. 1, which is a functional block diagram of a display device 10 according to an embodiment of the present invention. As shown in FIG. 1, the display device 10 includes a monitor 14, a storage unit 16, and a control unit 18. The monitor 14 could be preferably a flat display screen having a resolution adjustment function (e.g. a liquid crystal display screen, but not limited thereto). The monitor 14 has a plurality of transmission ports (only two transmission ports 20, 21 (e.g. an HDMI port, a DVI port, etc.) shown in FIG. 1, but not limited thereto). The plurality of transmission ports is connected to a plurality of image sources respectively (only two image sources 12, 13 (e.g. a computer host, a cable TV source, etc.) shown in FIG. 1, but not limited thereto), so that the monitor 14 can display images transmitted from the image sources via the transmission ports. The storage unit 16 could be preferably a memory device (e.g. an electrically erasable programmable read-only memory (EEPROM), but not limited thereto) commonly applied to a display monitor. The storage unit 16 is disposed in the monitor 14 to store an original product code and an original resolution parameter of the monitor 14, and the original product code and the original resolution parameter could preferably exist in an extended display identification data of the monitor 14. The control unit 18 could be a microprocessor (could include a scalar chip, a driving chip, etc.) commonly disposed in a display monitor for performing image processing operations (e.g. image signal decoding, resolution and frame-rate adjustment, etc.). The control unit 18 is electrically connected to the monitor 14 and the storage unit 16. Accordingly, the control unit 18 can perform a resolution parameter setting on each display area of the monitor 14 according to the original resolution parameter and a display layout provided by the monitor 14, and the control unit 18 can generate an updated product code and a plurality of updated resolution parameters corresponding to the plurality of display areas according to each resolution parameter setting, the original product code and the original resolution parameter, so as to optimize the resolution of each display area of the monitor 14.

Figure 2:
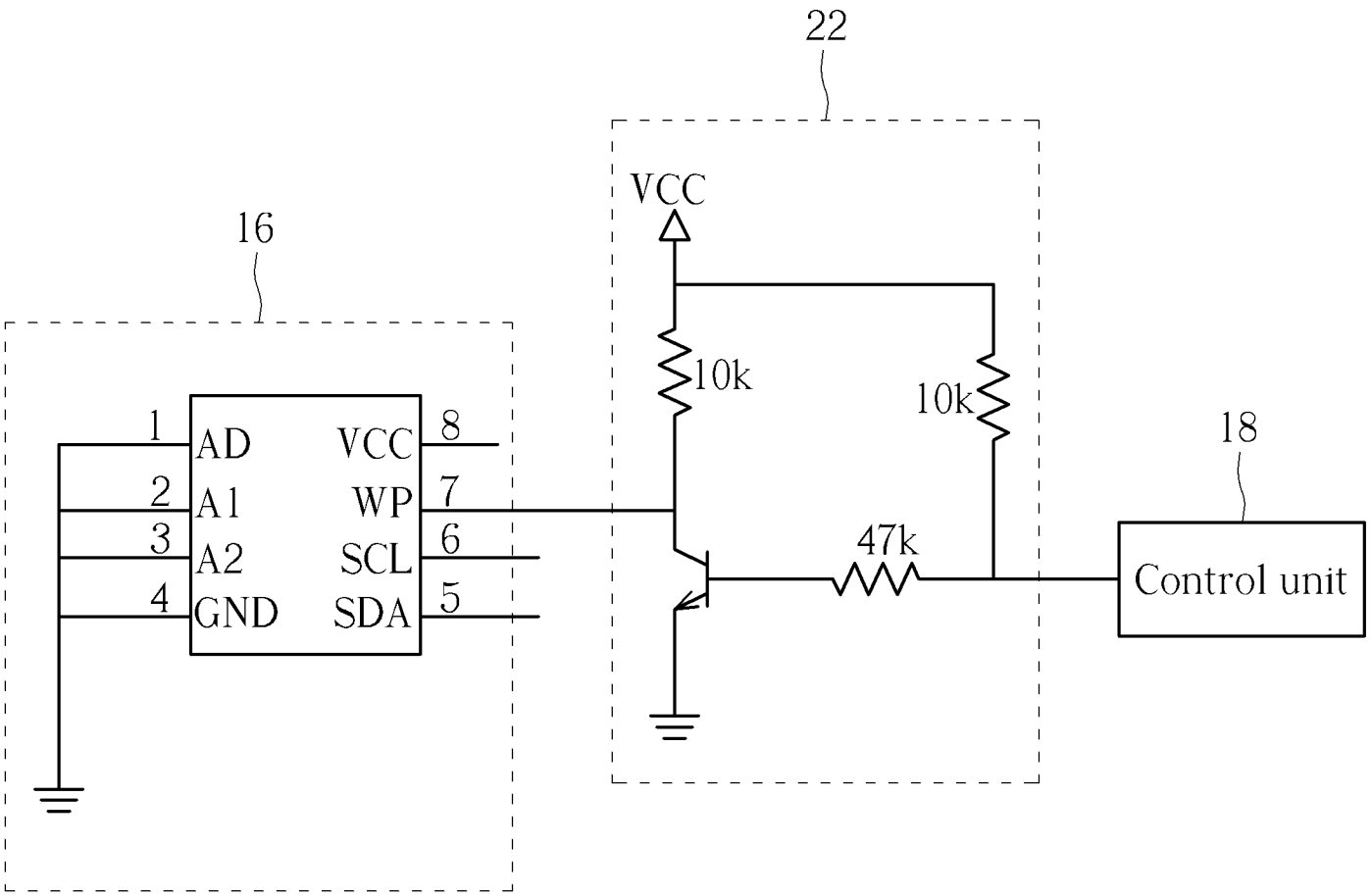
FIG. 2 is a diagram of a protection circuit in FIG. 1.

In practical application, the display device 10 could further include a protection circuit 22 (as shown in FIG. 2, but not limited thereto). The related description for the circuit design of the protection circuit 22 is omitted herein since it is commonly seen in the prior art. The protection circuit 22 is electrically connected to the control unit 18 and the storage unit 16. As such, the control unit 18 can provide a write-protection function to the storage unit 16 via the protection circuit 22 for surely preventing data loss or damage of the storage unit 16 caused by signal interferences.

Figure 3:
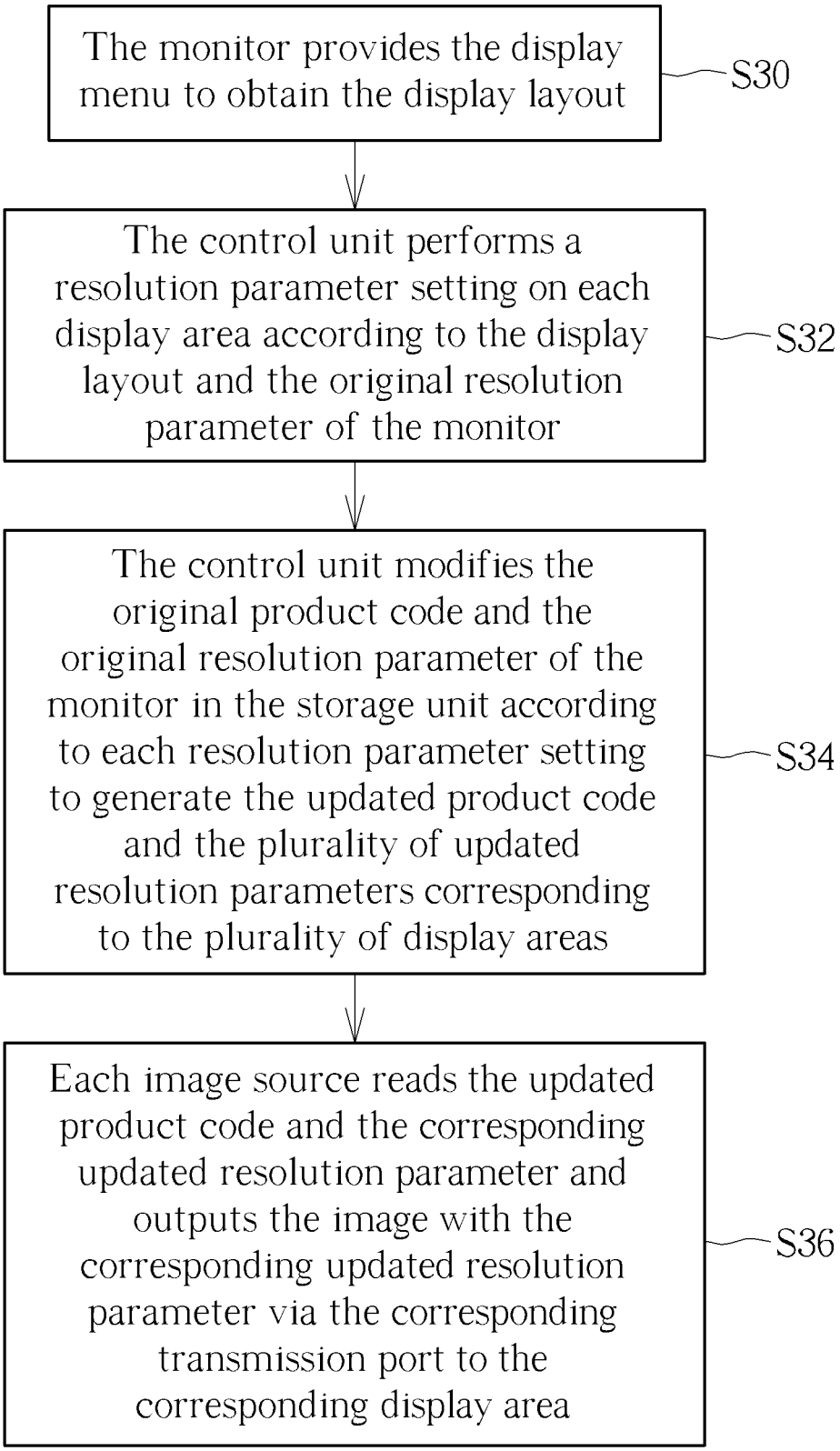
FIG. 3 is a flowchart of a resolution adjustment method according to an embodiment of the present invention.
Figure 4:
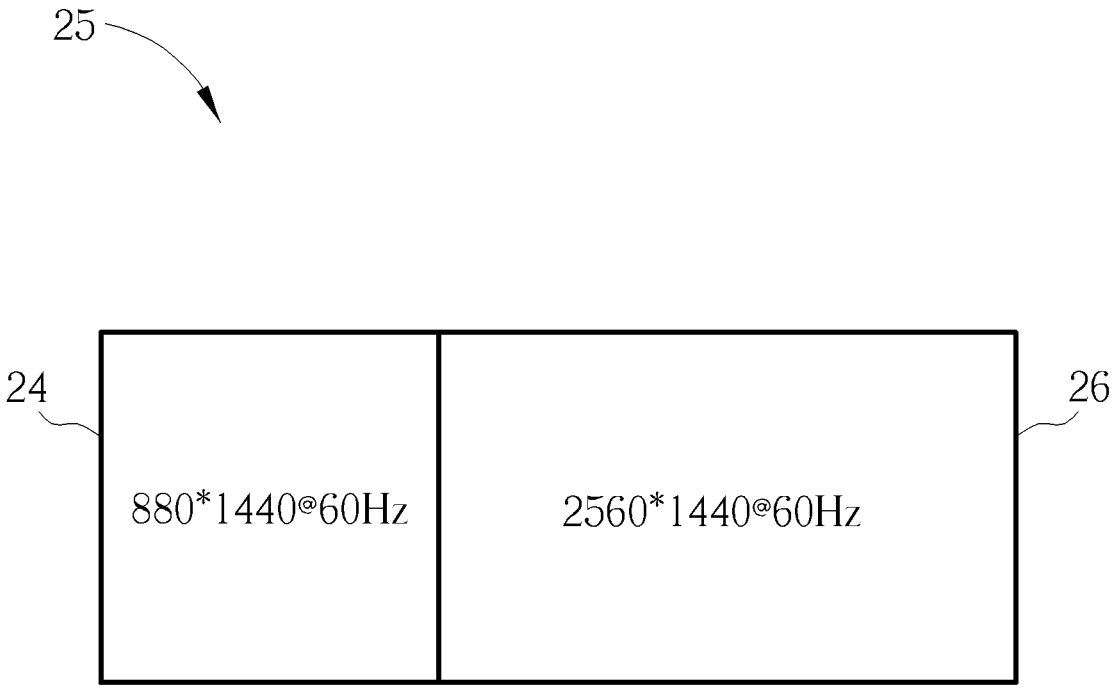
FIG. 4 is a diagram of a display layout of a monitor in FIG. 1.

More detailed description for the resolution adjustment method of the display device 10 is provided as follows. Please refer to FIG. 1, FIG. 3 and FIG. 4. FIG. 3 is a flowchart of the resolution adjustment method according to an embodiment of the present invention. FIG. 4 is a diagram of a display layout 25 of the monitor 14 in FIG. 1. The resolution adjustment method of the present invention includes the following steps.

Step S30: the monitor 14 provides a display menu to obtain the display layout 25;

Step S32: the control unit 18 performs a resolution parameter setting on each display area according to the display layout 25 and the original resolution parameter of the monitor 14;

Step S34: the control unit 18 modifies the original product code and the original resolution parameter of the monitor 14 in the storage unit 16 according to each resolution parameter setting to generate the updated product code and the plurality of updated resolution parameters corresponding to the plurality of display areas;

Step S36: each image source reads the updated product code and the corresponding updated resolution parameter and outputs an image with the corresponding updated resolution parameter via the corresponding transmission port to the corresponding display area.

The aforesaid steps are described in detail as follows in the embodiment that the monitor 14 has the display layout 25 as shown in FIG. 4, the original horizontal/vertical resolution of the monitor 14 is 3440*1440 and the frame rate of the monitor 14 is 60 Hz (but not limited thereto). In Step S30, the monitor 14 can provide the display menu to obtain the display layout 25. In this embodiment, the display layout 25 is composed of display areas 24, 26 arranged from left to right corresponding to the transmission ports 20, 21 respectively, but not limited thereto. That is, the present invention could adopt other PBP layout, PIP layout, or the combination thereof. For example, in another embodiment, two display areas located at a right side of the monitor 14 could be arranged from up to down and could be arranged together with a display area located at a left side of the monitor 14 from right to left, or a plurality of display areas could be arranged in a combination layout composed of a PBP layout and a PIP layout. The related description for the other layout designs could be reasoned by analogy according to the following description and omitted herein. To be more specific, in this step, the control unit 14 can preferably control the monitor 14 to display the display menu in an on-screen-display (OSD) manner (but not limited thereto, meaning that the present invention could adopt other menu design in another embodiment, such as a menu design that the monitor 14 could have physical buttons for a user to press), and the monitor 14 can obtain the display layout 25 according to an operation result for the display menu.

Subsequently, in Step S32, the control unit 18 can perform the resolution parameter setting on the display areas 24, 26 according to the original resolution parameter of the monitor 14 and the display layout 25. That is, as shown in FIG. 4, the control unit 18 can set the optimal horizontal/vertical resolution and the optimal frame rate of the display area 24 as 880*1440@60 Hz and set the optimal horizontal/vertical resolution and the optimal frame rate of the display area 26 as 2560*1440@60 Hz according to the original horizontal/vertical resolution and the frame rate of the monitor 14 (i.e. 3440*1440@60 Hz).

After the resolution parameter setting step is completed, as mentioned in Step S34, the control unit 18 can modify the original product code and the original resolution parameter in the extended display identification data of the monitor 14, which are stored in the storage unit 16, according to the aforesaid resolution parameter settings respectively corresponding to the display area 24 and the display area 26, for generating the updated product code and the updated resolution parameters respectively corresponding to the display area 24 and the display area 26. For example, the control unit 18 can modify the original product code E01A and the original resolution parameter 3440*1440@60 Hz, which are recorded in the extended display identification data of the monitor 14, to be the updated product code E01B and the updated resolution parameters 880*1440@60 Hz, 2560*1440@60 Hz respectively corresponding to the transmission ports 20, 21 (but not limited thereto). To be noted, the updated resolution parameter could selectively include at least one of the horizontal resolution parameter, the vertical resolution parameter, and the frame rate. For example, in another embodiment, the control unit 18 could just modify the horizontal/vertical resolution or the frame rate of the monitor 14. As for the related description for the derived embodiments of the updated resolution parameter setting, it could be reasoned by analogy according to the aforesaid description and omitted herein.

Finally, in Step S36, the image source 12 can read the updated product code and the corresponding updated resolution parameter and output an image with the corresponding updated resolution parameter to the display area 24 via the transmission port 20, and the image source 13 can read the updated product code and the corresponding updated resolution parameter and output an image with the corresponding updated resolution parameter to the display area 26 via the transmission port 21. To be more specific, in this embodiment, the present invention can adopt the hot plug signal design (but not limited thereto, meaning that the present invention could adopt the manual plugging design in another embodiment) to control the image sources 20, 21 to read the extended display identification data of the monitor 14 again. For example, the control unit 18 can control the monitor 14 to output a hot plug signal to the image sources 12, 13 via the transmission ports 20, 21 respectively. As such, the image source 12 can read the updated product code E01B and the updated resolution parameter 880*1440@60

Hz via the transmission port 20, which are recorded in the modified extended display identification data, and the image source 13 can read the updated product code E01B and the updated resolution parameter 2560*1440@60 Hz via the transmission port 21, which are recorded in the modified extended display identification data. In such a manner, the image source 12 can output the image with the updated resolution parameter 880*1440@60 Hz to the display area 24 via the transmission port 20, and the image source 13 can output the image with the updated resolution parameter 2560*1440@60 Hz to the display area 26 via the transmission port 21, so as to generate the effect that display of each display area can be optimized.

In summary, the present invention adopts the resolution adjustment method for modifying the original resolution parameter of the display device according to the display layout of the display device. Accordingly, no matter which type of display layout is displayed on the display device, the resolution of the image transmitted from each image source can be precisely matched with the resolution of the corresponding display area. In such a manner, the present invention can efficiently solve the fuzzy image or ratio distortion problem in the prior art, which is caused by the resolution of the secondary display area being not matched with the resolution of the image transmitted from the image source.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A resolution adjustment method applied to image display of a display device, the display device having a plurality of transmission ports to be connected to a plurality of image sources respectively, the resolution adjustment method comprising:

the display device providing a display menu to obtain a display layout, the display layout being composed of a plurality of display areas respectively corresponding to the plurality of transmission ports;

the display device performing a resolution parameter setting on each display area according to the display layout and an original resolution parameter of the display device;

the display device generating an updated product code and a plurality of updated resolution parameters corresponding to the plurality of display areas according to an original product code and the original resolution parameter of the display device and each resolution parameter setting, each updated resolution parameter comprising a frame rate; and each image source reading the updated product code and the corresponding updated resolution parameter and outputting an image with the corresponding updated resolution parameter via the corresponding transmission port to the corresponding display area, to make an optimal frame rate of each display area matched with an original frame rate of the display device.

2. The resolution adjustment method of claim 1, wherein the step of each image source reading the updated product code and the corresponding updated resolution parameter comprises:

the display device outputting a hot plug signal to each image source via the plurality of transmission ports; and each image source reading the updated product code and the corresponding updated resolution parameter via the corresponding transmission port after receiving the hot plug signal.

3. The resolution adjustment method of claim 1, wherein the display layout comprises at least one of a picture-by-picture (PBP) layout and a picture-in-picture (PIP) layout.

4. The resolution adjustment method of claim 1, wherein the step of the display device providing the display menu to obtain the display layout comprises:

the display device displaying the display menu in an on-screen-display (OSD) manner; and the display device obtaining the display layout according to an operation result for the display menu.

5. The resolution adjustment method of claim 1, wherein the original product code and the original resolution parameter exist in an extended display identification data (EDID) of the display device.

6. A display device having a resolution adjustment function applied to image display of a plurality of image sources, the display device comprising:

a monitor having a plurality of transmission ports to be connected to the plurality of image sources respectively, the monitor providing a display menu to obtain a display layout, the display layout being composed of a plurality of display areas corresponding to the plurality of transmission ports;

a storage unit disposed in the monitor, an original product code and an original resolution parameter of the monitor being stored in the storage unit; and a control unit electrically connected to the monitor and the storage unit, the control unit performing a resolution parameter setting on each display area according to the display layout and the original resolution parameter, the control unit generating an updated product code and a plurality of updated resolution parameters corresponding to the plurality of display areas according to the original product code, the original resolution parameter and each resolution parameter setting, each updated resolution parameter comprising a frame rate;

wherein each image source reads the updated product code and the corresponding updated resolution parameter stored in the storage unit and outputs an image with the corresponding updated resolution parameter via the corresponding transmission port to the corresponding display area, to make an optimal frame rate of each display area matched with an original frame rate of the monitor.

7. The display device of claim 6 further comprising:

a protection circuit electrically connected to the control unit and the storage unit, the control unit providing a write-protection function to the storage unit via the protection circuit.

8. The display device of claim 6, wherein the control unit controls the monitor to output a hot plug signal to each image source via the plurality of transmission ports, and each image source reads the updated product code and the corresponding updated resolution parameter via the corresponding transmission port after receiving the hot plug signal.

9. The display device of claim 6, wherein the display layout comprises at least one of a picture-by-picture layout and a picture-in-picture layout.

10. The display device of claim 6, wherein the control unit controls the monitor to display the display menu in an on-screen-display manner, and the monitor obtains the display layout according to an operation result for the display menu.

11. The display device of claim 6, wherein the storage unit is an electrically erasable programmable read-only memory (EEPROM), and the original product code and the original resolution parameter exist in an extended display identification data of the display device.

* * * * *